United States Patent [19]

Stewart

[11] 4,115,862

[45] Sep. 19, 1978

[54] PROCESS CONTROL METHOD AND APPARATUS

[75] Inventor: William S. Stewart, Bartlesville, Okla.

[73] Assignee: Phillips Petroleum Company, Bartlesville, Okla.

[21] Appl. No.: 808,000

[22] Filed: Jun. 20, 1977

[51] Int. Cl.[2] ..... G06G 7/58; F23N 1/00

[52] U.S. Cl. ..... 364/500; 23/230 A; 236/15 E; 423/360; 431/12; 422/109

[58] Field of Search ..... 235/151.12, 151.1; 23/253 A, 230 A; 236/14, 15 E, 1 A; 137/6, 7, 90; 431/12, 2, 18; 423/352, 359, 360; 208/DIG. 1, 134; 364/500, 502

[56] References Cited

U.S. PATENT DOCUMENTS

| | | | |
|---|---|---|---|
| 3,503,553 | 3/1970 | Schomaker | 236/14 |
| 3,721,253 | 3/1973 | Remke | 23/230 A X |
| 3,722,811 | 3/1973 | Osburn | 236/14 |
| 3,824,388 | 7/1974 | Cugini | 235/151.12 |
| 3,993,447 | 11/1976 | Buss et al. | 236/15 E X |
| 4,028,194 | 6/1977 | Boyd | 235/151.12 X |

*Primary Examiner*—Joseph F. Ruggiero

[57] ABSTRACT

A method and apparatus is provided for controlling the operation of a reforming furnace used to decompose at least a portion of a feed stream. A by-product fuel from subsequent process steps, which is a result of decomposition of the feed in the furnace, is used as one fuel source to fire the furnace. The control system monitors the byproduct fuel stream and the feed stream to a decomposition side of the furnace and determines the feed rate of additional fuel required to fire the furnace, which feed rate is correspondingly controlled. The control system includes means for determining various selected variables as sensed by suitable analyzers and flow rate meters and comparing certain variables to determine the flow rate of the additional fuel required to fire the furnace.

12 Claims, 1 Drawing Figure

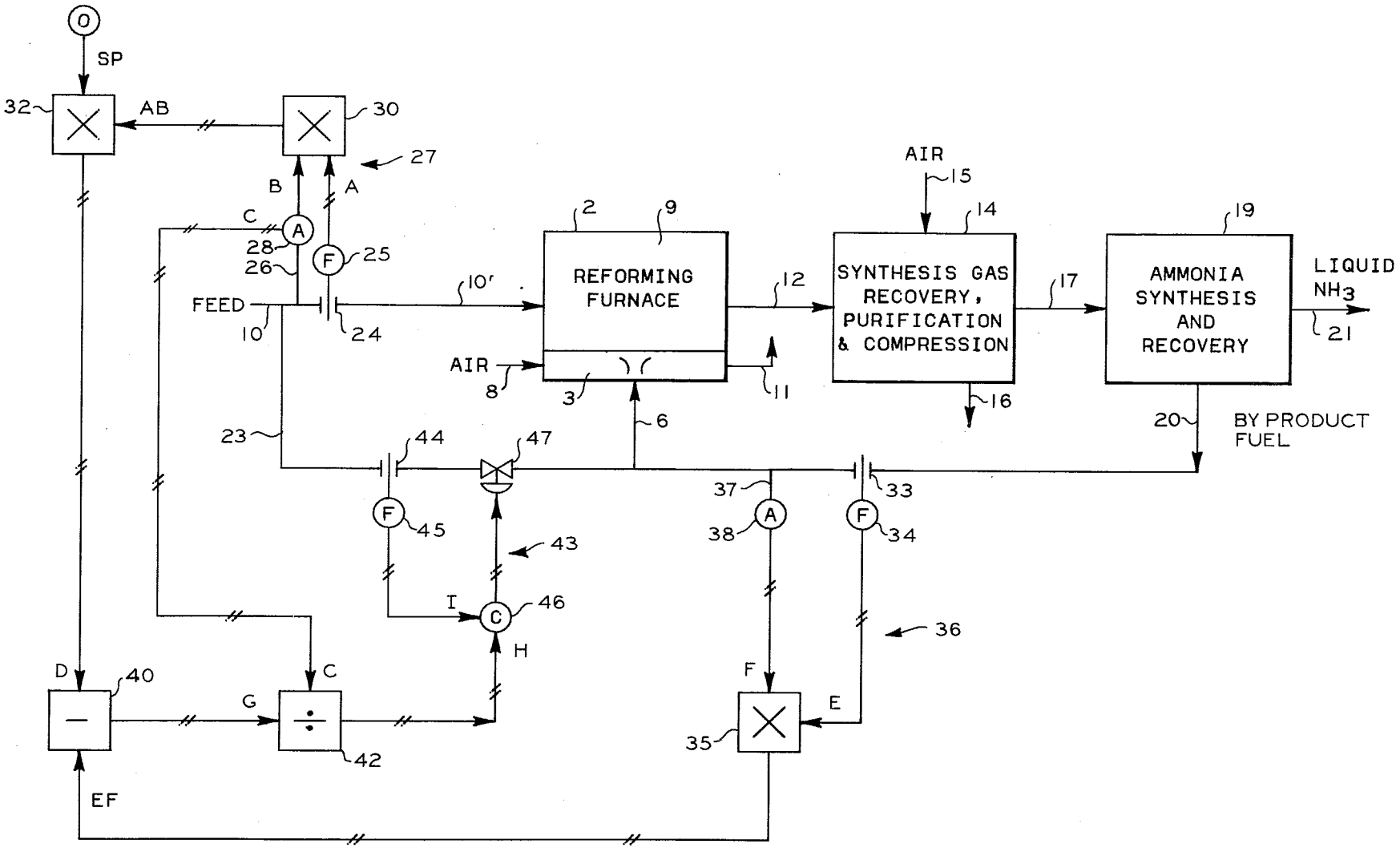
LIQUID NH3
21
AMMONIA SYNTHESIS AND RECOVERY
19
BY PRODUCT FUEL
20
17
SYNTHESIS GAS RECOVERY, PURIFICATION & COMPRESSION
14
16
AIR
15
REFORMING FURNACE
9
2
12
11
6
3
AIR
8
10'
FEED
10
23
24
25
26
28
27
30
A
B
C
AB
SP
32
33
34
36
E
F
35
37
38
A
43
47
46
C
H
I
44
45
F
42
C
G
40
D
EF

PROCESS CONTROL METHOD AND APPARATUS

The present invention relates to an apparatus and method for controlling fuel input from a plurality of sources to a furnace and more particularly for use when the fuel has a varying heating value and the furnace has a varying heat demand.

In various processes using furnaces for decomposing a hydrocarbon feed such as in an ammonia synthesis plant, the final by-products include a combustible fuel portion which can be returned to the reforming furnace to be used as fuel for heating the feed hydrocarbon to its decomposition temperature. However, at certain times there is not a sufficient quantity of this by-product combustible fuel available to provide sufficient heat to the reforming furnace for its proper operation. Therefore, it is necessary to add supplemental fuel to the furnace to insure that sufficient heat is available for decomposing the feed hydrocarbon. It is desirable in such processes to use the most economical fuel available, for example a material which would normally be a waste product, as the major component of the total fuel to the reforming furnace to minimize the use of more expensive supplemental fuel. Therefore, it is important to have a control system which will minimize the use of supplemental fuel in the reforming furnace while providing the required heat input.

The principal objects and advantages of the present invention are: to provide a control system operable for controlling the fuel input to a furnace wherein the fuel can be supplied from one or both of two sources with the control system being further operable for maintaining the input of supplemental fuel at a minimum in accordance with the heat demand of the furnace; to provide a control system which is operable for computing the heat demand of the furnace; to provide a control system which measures the heating value per unit time of by-product fuel and computes from this value and the heat input rate required for feed decomposition, the input rate of supplemental fuel required; and to provide a control system and operating method which are well adapted for their intended use.

Other objects and advantages of the present invention will become apparent from the following detailed description taken in connection with the accompanying drawing wherein are set forth by way of illustration and example certain embodiments of this invention.

FIG. 1 is a schematic illustration of the control system and apparatus to which the control system is operably connected.

For purposes of illustration the apparatus is described in terms of an ammonia synthesis plant. However, it is to be understood that the control system can be used with other processes in which a by-product stream produced in a downstream process step is used as a fuel source to fire a furnace. This by-product fuel stream is generally not sufficient in combustion heating value per unit time to provide all of the heat required by the furnace, whereby supplemental fuel is required to provide additional needed heat.

A feed-using means such as a reforming furnace 2 has a heating side or burner 3 which is connected to a conduit 6 operable for supplying fuel to the burner 3 and also has a conduit 8 operable for supplying air to the burner 3. A carbonaceous feed such as a light hydrocarbon, for example natural gas, is introduced into the reforming furnace to a cracking, conversion or decomposition side 9 thereof through a conduit 10' which is connected in flow communication with a conduit 10 which in turn is connected to a source of hydrocarbon feed. Combustion products from the burner 3 are discharged through a vent or stack 11. The hydrocarbon feed fed to the furnace 2 is cracked, decomposed or otherwise converted by heat supplied from the burner 3. For example, if the hydrocarbon feed is natural gas, which contains methane and ethane, the feed can be cracked thermally or catalytically in the presence of steam to produce a hot gas mixture principally comprising hydrogen, carbon monoxide and carbon dioxide. This hot gas mixture is discharged from the furnace 2 via a conduit 12 which connects, in flow communication, the furnace 2 to an apparatus 14 operable for recovering ammonia synthesis gas and purifying and compressing this synthesis gas stream. Air is supplied to the apparatus 14 via an inlet 15 and impurities removed by the purification steps are discharged through a discharge 16. The synthesis gas mixture, comprising principally hydrogen and nitrogen with low concentrations of argon (from the air), helium (if brought in by the natural gas feed) and methane (unconverted by the cracking-reforming step), is discharged from the apparatus 14 via a conduit 17 which connects, in flow communication, the apparatus 14 to an apparatus 19 which is operable for partially converting, catalytically or otherwise, the nitrogen and hydrogen to form ammonia. The apparatus 19 is also operable for separating, as by liquefaction, the ammonia from a recirculating synthesis gas stream, a portion of which gas stream is withdrawn and returned as the by-product fuel stream for burner 3 so as to maintain the total concentration of argon, helium, methane, etc. at a tolerable level in the ammonia synthesis cycle in apparatus 19. This withdrawn by-product portion (synthesis cycle purge stream) is returned through a discharge conduit 20. The recovered ammonia is discharged through an outlet 21. The thus-far described ammonia synthesis process is conventional. The by-product fuel discharge 20 is connected, in flow communication, to the conduit 6 for supplying both of the combustible fuels to the heating side or burner 3 of the furnace 2.

A control system is provided and is operable for determining the total combustion heating value per unit time of the by-product fuel while also determining the cracking or conversion heat requirement rate needed to decompose the hydrocarbon feed to the furnace 2. The control system computes the flow rate of supplemental fuel required for cracking the feed hydrocarbon to the desired degree. Preferably, and as illustrated, the supplemental fuel is taken from the feed hydrocarbon conduit 10 via a conduit 23 which is in flow communication between the conduit 10 and burner fuel supply conduit 6. However, it is to be understood that another fuel source can be used and possibly minor changes in the below-described control system would be required.

The control system includes a first flow rate measuring element 24 positioned in the feed conduit 10' for measuring the flow rate of the hydrocarbon feed flowing therethrough which includes at least a portion of the feed hydrocarbon from the conduit 10. Computing means 27 is provided and is operable for providing a flow rate signal A, an analysis signal B and a heating value signal C and a mathematical product signal AB. Preferably the computing means includes a flow rate transmitter 25 operably connected to the first flow measuring element 24 for delivering a signal A representative of the flow rate of the hydrocarbon feed in terms of volume of feed per unit time. The hydrocarbon feed flowing through the conduit 10' is sampled by removing a sample through conduit 26 and analyzed by a conventional analyzer 28, such as a chromatographic analyzer, which includes a signal transmitter. The transmitter portion of the analyzer 28 delivers a signal B representative of the summation of the concentrations of reformable hydrocarbons in the conduit 10' and a signal C representative of the combustion heating value per unit volume of the hydrocarbon stream in the conduit 10'.

If the composition of the feed hydrocarbon is sufficiently constant, such as with well-processed natural gas streams (as opposed to field gases and plant combustible waste gases), average values may be used as manual inputs for signal B to computer 30, and for signal C.

The signals A and B are transmitted to the computer 30 which preferably is a multiplier and combines the signals A and B to provide a mathematical product signal AB which is representative of the volume per unit time of reformable hydrocarbon flowing from the conduit 10 through the conduit 10' into the decomposition side 9 of furnace 2. This signal AB is transmitted to a computing means 32 which preferably is a multiplier and has a multiplying factor or set point designated as SP, which is representative of the furnace heat required per unit volume of reformable hydrocarbons to achieve the desired degree of conversion in the reforming furnace 2. The signal AB is multiplied in the computing means 32 by the set point SP and a signal D is generated which is representative of the total required heat input per unit time to the furnace 2 to reform the feed hydrocarbon.

The by-product fuel flowing in the conduit 20 is monitored by a flow measuring element 33 which is operable for measuring the flow rate of the by-product fuel. A flow rate transmitter 34 is operably connected to the flow measuring element 33 and provides the signal E which is representative of the flow rate of the by-product fuel in terms of volume per unit time to a computing means 35 which preferably is a multiplier. The by-product fuel flowing in the conduit 20 is sampled via a conduit 37 connected to the conduit 20 wherein the by-product fuel is analyzed by a suitable analyzer 38, such as a chromatographic analyzer, which includes a signal transmitter. The transmitter portion of the analyzer 38 delivers the signal F which is representative of the heating value per unit volume of the by-product fuel. The signal F is also transmitted to the computing means 35 which combines the signal E and F to thereby provide the product signal EF which is representative of the heating value per unit time of the by-product fuel flowing through the conduit 20.

The signals D and EF are transmitted to a computing means 40 which preferably is a substractor and is operable to provide a difference signal G which is representative of the additional heat per unit time required to achieve the desired degree of conversion or decomposition of the hydrocarbon feed flowing from the conduit 10' into the decomposition side 9 of the furnace 2. The signals C and G are transmitted to a computing means 42 which preferably is a divider and is operable for providing a quotient signal H (G/C) which is representative of the volume per unit time of the feed hydrocarbon stream which needs to be added via line 23 to the by-product fuel flowing in conduit 20 in order to provide a combined fuel stream to conduit 6 which has the required combustion heating value per unit time to achieve the desired degree of conversion of the hydrocarbon feed. The signal H is transmitted to control means 43 which is operable to continuously control the flow rate of the supplemental fuel flowing in conduit 23 at a rate sufficient to provide the additional heat required by the furnace 2. The control means 43 includes a flow sensing element 44 which is operable to measure the flow rate of the supplemental fuel flowing in the conduit 23. The flow sensing element 44 is connected to a flow rate transmitter 45 which is operable for generating a signal I which is representative of the flow rate of the supplemental fuel in the conduit 23. The signal I is transmitted to a suitable flow controller 46 which is operably connected to a flow control valve 47 which is connected in the conduit 23. The flow controller 46 compares the signals H and I and adjusts the valve 47 accordingly to provide the volume per unit time of hydrocarbon feed needed as supplemental fuel for combustion in furnace 2.

Computing means, comprising multipliers 30, 32 and 35, divider 42 and subtractor 40, flow rate transmitters 25, 34 and 45, controller 46, and analyzers 28 and 38 are compatibly integrated by pneumatic or preferably electronic analog techniques well known in the art. Such techniques are described in detail in "Applications of Operational Amplifiers" Jerald G. Graeme, McGraw-Hill 1973, and in "Chemical Engineer's Handbook", Fifth Edition (1973) McGraw-Hill, Chapter 22, in particular pages 22–70 through 73, 22–104 through 137. Computing means 30, 32, 35, 42, 40 and at least a portion of the computing requirements of analyzers 28 and 38 may be accomplished by proper calibration and use of analog equipment such as the Model 603 manifold described on page 23 of the Burr-Brown Research Corporation Handbook and Catalog of Operational Amplifiers LI-227 dated 1969. Flow rate transmitters and other control components suitable to accomplish this novel measurement, computing, controlling method are readily available from process instrument manufacturers such as The Foxboro Company, Foxboro, Massachusetts and others as given in U.S Pat. No. 3,734,675.

Chromatographic analysis technique is discussed in "Chemical Engineers' Handbook" pages 22–50 and a data reduction technique to produce calculated gas combustion heating value from component analysis is given in U.S. Pat. No. 3,095,728. Analyzers 28 and 38 with suitable analog computing capability are available from Applied Automation, Inc., Bartlesville, Oklahoma and other manufacturers.

If desired, the computing and control operations may be implemented with digital equipment, generally known as Direct Digital Control, employing transducers to convert from analog signals to digital and vice versa as required in a well-engineered system.

It is to be understood that while there has been illustrated and described certain forms of this invention, it is not to be limited to the specific form or arrangement of parts or steps herein described and shown except to the extent that such limitations are found in the claims.

What is claimed and desired to be secured by Letters Patent is:

1. An apparatus which includes a control system, for controlling the addition of a first fuel to a using means, said apparatus including:

first computing means operably associated with a feed stream containing a reformable hydrocarbon portion and operable for generating a signal AB representative of the volume flow rate of the feed stream reformable hydrocarbon portion to a first using means;

first means operable for providing a signal C representative of the combustion heating value per unit volume of a first fuel stream operable for supplying at least a portion of total fuel to the first using means;

second computing means operable for receiving the signal AB and generating a signal D representative of the required input of heat per unit time to the first using means;

third computing means operably associated with a second fuel stream and operable for generating a signal EF representative of the combustion heating value per unit time of the fuel comprising the second fuel stream, said second fuel stream being operable for supplying at least a portion of the total fuel to said first using means;

fourth computing means operable for receiving the signals D and EF and determining the difference between the signals D and EF to provide a signal G representative of additional heat per unit time required by the first using means;

fifth computing means operable for receiving the signals C and G and providing a signal H representative of the volume per unit time of the first fuel required by the first using means;

first control means operable for receiving the signal H and controlling the flow rate of the first fuel to the first using means in response to the signal H.

2. An apparatus set forth in claim 1 wherein:

said first using means includes a furnace operable for cracking at least a portion of the feed stream by heating to a suitable cracking temperature with heat supplied to the furnace by combustion of the first and second fuels.

3. An apparatus as set forth in claim 2 wherein said first computing means including:

a first multiplying computer;

a first flow rate sensing and transmitting means operably associated with the first multiplying computer and the feed stream and being operable for generating the signal A representative of the volume per unit time of feed flowing in the feed stream to a cracking side of the furnace and being further operable for transmitting the signal A to the first product computer; and said first means including a first analyzing means operably associated with the fifth computing means, the first multiplying computer and the feed stream, said first fuel stream including a portion of the feed stream, and being operable for generating a signal B representative of the reformable hydrocarbon portion of the feed stream flowing into the cracking side of the furnace, and also operable for generating the signal C and being operable for transmitting the signal B to the first multiplying computer which is operable to multiply the signals A and B to produce the signal AB, said first analyzing means also being operable for transmitting the signal C to the fifth computing means.

4. An apparatus as set forth in claim 3 wherein said third computing means including:

a second multiplying computer;

a second flow rate sensing and transmitting means operably associated with the second multiplying computer and the second fuel stream and operable for generating a signal E representative of the volume per unit time of the fuel flowing in the second fuel stream to a heating side of the furnace and being further operable for transmitting the signal E to the second multiplying computer; and a second analyzing means operably associated with the second multiplying computer and the second fuel stream and being operable for generating a signal F representative of heating value per unit volume of the fuel and being further operable for transmitting the signal F to the second multiplying computer which is operable to multiply the signals E and F to produce the signal EF.

5. An apparatus as set forth in claim 4 including:

a first conduit means operable for flow of the feed stream therethrough from a source of feed to the cracking side of the furnace; and a second conduit means communicating with the first conduit means upstream of the first flow sensing means and also communicating with the heating side of the furnace and operable for supplying a portion of the feed stream to the heating side of the furnace as at least a portion of the first fuel.

6. An apparatus as set forth in claim 5 wherein:

said first using means is an ammonia synthesis apparatus and said second fuel stream is a by-product from a portion of the ammonia synthesis apparatus.

7. A method for controlling thermal cracking of at least a portion of a feed hydrocarbon stream wherein heat is supplied for cracking by the combustion of a fuel stream and a supplemental fuel stream, said method including the steps of:

measuring the cracking heat input per unit time requirement for a predetermined level of cracking of said portion of the feed hydrocarbon stream;

measuring the combustion heating value per unit time of the fuel stream;

determining the quantity per unit time of supplemental fuel needed to supplement the combustion heating value of said fuel stream to produce the required cracking heat input; and combining the required amount of the supplemental fuel with fuel from said fuel stream.

8. A method as set forth in claim 7 including measuring the combustion heating value per unit time of the supplemental fuel stream.

9. A method as set forth in claim 8 wherein:

at least a portion of products resulting from the cracking are used for synthesis of ammonia; and said fuel is a by-product fuel from the ammonia synthesis process.

10. A method for controlling thermal cracking of at least a portion of a feed hydrocarbon stream wherein heat is supplied for cracking by the combustion of a fuel stream and a supplemental fuel stream, said method including the steps of:

producing a signal D representative of the heat input per unit time required for a predetermined level of cracking of said portion of the feed hydrocarbon stream;

analyzing said fuel stream and producing a signal F representative of the heating value of the fuel of the fuel stream;

measuring the flow rate of said fuel stream and producing a signal E representative of the flow rate;

multiplying the signals E and F and producing a signal EF representative of the heating value per unit time of the fuel of said fuel stream used in combustion;

subtracting the signal EF from the signal D and producing a signal G representative of additional heat required for cracking; and adding supplemental fuel for combustion in response to said signal G.

11. A method as set forth in claim 7 wherein said supplemental fuel is a first portion of said feed hydrocarbon stream; and further including:

analyzing said feed hydrocarbon and producing a signal C representative of the heating value of said feed hydrocarbon;

dividing the signal G by the signal C and producing a signal H representative of the volume per unit time of feed hydrocarbon needed as supplemental fuel;

controlling the flow rate of added supplemental fuel in response to the signal H.

12. A method as set forth in claim 11 including:

measuring the flow rate of a second portion of feed hydrocarbon to be cracked and producing a signal A representative of the flow rate of the second portion;

producing a signal B representative of the concentration of reformable hydrocarbon in the feed hydrocarbon;

multiplying the signals A and B and producing a signal AB representative of the volume per unit time of the reformable hydrocarbon to be cracked;

multiplying the signal AB by a set point to produce the signal D.

* * * * *